United States Patent [19]

Warne

[11] 4,298,445

[45] Nov. 3, 1981

[54] ANODE FOR CATHODIC PROTECTION SYSTEM

[75] Inventor: Michael A. Warne, Brewood, England

[73] Assignee: Marston Excelsior Limited, Wolverhampton, England

[21] Appl. No.: 903,036

[22] Filed: May 5, 1978

[30] Foreign Application Priority Data

May 9, 1977 [GB] United Kingdom ..... 19384/77

[51] Int. Cl.[3] ..... C23F 13/00

[52] U.S. Cl. ..... 204/196; 204/284; 204/286; 204/290 F

[58] Field of Search ..... 204/147, 196, 290 F, 204/284, 286

[56] References Cited

U.S. PATENT DOCUMENTS

| | | | |
|---|---|---|---|
| 2,756,204 | 7/1956 | Higgins | 204/197 |
| 3,278,404 | 10/1966 | Cotton et al. | 204/196 |
| 3,313,721 | 4/1967 | Teel | 204/196 |
| 3,349,017 | 10/1967 | Ziegler | 204/196 |
| 3,376,209 | 4/1968 | Sabins | 204/196 |
| 3,425,925 | 2/1969 | Fleischman | 204/197 |
| 3,530,051 | 9/1970 | Ueda et al. | 204/196 |
| 3,625,852 | 12/1971 | Anderson | 204/196 |
| 3,880,721 | 4/1975 | Littauer | 204/196 |

FOREIGN PATENT DOCUMENTS

| | | |
|---|---|---|
| 1229816 | 12/1959 | Fed. Rep. of Germany . |
| 600071 | 3/1948 | United Kingdom . |
| 809006 | 2/1959 | United Kingdom . |
| 877901 | 9/1961 | United Kingdom . |
| 1347469 | 2/1974 | United Kingdom . |
| 1418557 | 12/1975 | United Kingdom . |
| 1467894 | 3/1977 | United Kingdom . |

*Primary Examiner*—G. L. Kaplan

*Attorney, Agent, or Firm*—Cushman, Darby & Cushman

[57] ABSTRACT

A cathodic protection anode incorporating a lattice-work anode of increased strength.

9 Claims, 6 Drawing Figures

ANODE FOR CATHODIC PROTECTION SYSTEM

Figure 2:
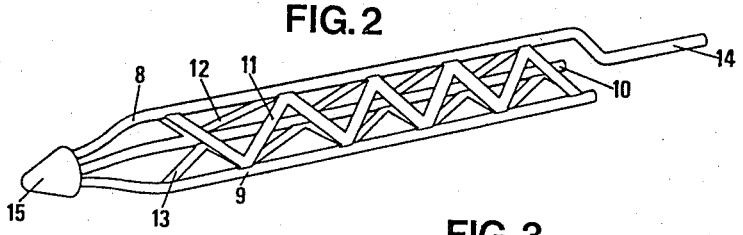

This invention relates to anodes and has particular relevance to impressed current cathodic protection anodes.

Cathodic protection is a technique widely used to protect steel and iron structures in corrosive environments such as the sea. Basically there are two types of cathodic protection systems, the first type utilising sacrificial anodes of magnesium, aluminium or zinc and the second type using impressed current anodes. Whereas sacrificial anodes dissolve by way of their higher electrochemical potential thereby making the steel structure to be protected cathodic and thus protecting it, impressed current anodes are basically inert. The impressed current anodes are connected to a source of electrical current as an anode and evolve chlorine or oxygen at their surfaces. By making the steel structure cathodic with respect to the impressed current anodes it is thereby protected.

Because of the vital importance of the durability of the impressed current anodes they are conventionally made from a film-forming metal such as titanium or niobium and coated with a platinum group metal, usually platinum. In certain extreme conditions such as are encountered in the North Sea certain operators require the ability to check the anodes periodically. An arrangement has been proposed therefore—see British Pat. No. 1 347 469—by which the anodes can be made retractable for inspection as desired. Basically the arrangement described in the British patent specification comprises a tube extending from the surface down towards the bottom of the steel structure. A cathodic protection anode is then dropped down through the tube to project beyond the bottom of the tube. It will be appreciated that in these circumstances the anode is supported only at one end, the free end being completely unsupported. Since it is preferable that the cathodic protection anode be positioned a certain distance away from the structure to be protected—for maximum throwing power—then the anode is often located so as to project into the open sea.

To protect a large structure high currents have to be passed through the cathodic protection anode. Basically the protection afforded by the cathodic protection system is proportional to the current passed whereas the power costs are proportional to the wattage, ie the current times the voltage. It has been found that there is a difference in the ability of an anode to transfer electrical current into seawater at a given voltage dependent upon its geometry. Thus, if two anodes are taken, firstly 30 mm diameter rod 1.6 m long with a platinum surface, and secondly 12 mm diameter rod 4 m long with a platinum surface, their areas are approximately equal. The 30 mm diameter rod will, however, only pass 7.73 amps of current for each applied volt whereas the 12 mm diameter rod will pass 13.19 amps. It can be seen, therefore, that it is desirable for cathodic protection anodes to be long and thin rather than short and fat. There is a further advantage in using long, thin anodes in that by reducing the applied voltage breakdown at the anode surface can be reduced and also the danger to divers is reduced. Further the dielectric shielding necessary for the anode is also reduced.

Unfortunately, however, sea conditions in the open sea and loads imposed on launching platforms to which cathodic protection anodes are attached are such as to damage long, thin anodes by causing them to vibrate, bend or fatigue. It can be seen, therefore, that there are contradictory requirements imposed on the anode—it should be short and fat from a mechanical viewpoint but long and thin from an electrical viewpoint.

A further problem is that the most effective film-forming metal for anodes undergoing the most extremes of conditions is niobium. Niobium is expensive and thus thick-walled niobium tubes would be expensive to manufacture and expensive in terms of the amount of material used.

These problems associated with the use of the retractable anodes have, to date, proved expensive and difficult to overcome. In certain circumstances it has proved necessary to replace damaged anodes and in the British Pat. No. 1 347 469 it is stated that the anode can be retracted into the shielded position during extremely severe seas to protect it. Unfortunately, however, retracted anodes are not effective to prevent corrosion and thus the steel structures can corrode when the anodes are in the withdrawn and protected positions.

By the present invention there is provided an impressed current corrosion-protecting anode including at least three rods of metal, at least one of which is suitable for use as a cathodic protection anode, the rods being joined together by interconnecting rigid ties so that the centre lines of the rods lie in at least three planes, the rods being connectable at one end to a source of electrical current and being adapted and arranged to be supported, in use, at the one end only in the form of a cantilever.

The rods are preferably formed of a film-forming metal chosen from the group titanium, zirconium, niobium, hafnium and tantalum, having an anodically active material on their surface. Preferably all of the rods have anodically active material on their surface. The rods may have a core of a metal, such as copper or aluminium, of a higher electrical conductivity than the film-forming metal. The rods may further have a core of a reinforcing metal such as steel. The anodically active material may be a metal, alloy or anodically active compound of a platinum group metal. The anodically active material is preferably platinum. The film-forming metal is preferably niobium or titanium.

There are preferably three rods welded to spacing and supporting ties. The rods preferably are equally spaced apart so that, in cross-section, the centres of the rods lie on an equilateral triangle. The rigid ties are preferably welded to the rods and may be in the form of a zig-zag extending between two rods (there being a plurality of zig-zags) or a strap welded around the three rods or individual ties interconnecting pairs of rods.

The rods may be bent towards a single common position and be provided with a nose piece at that position, the nose piece being at the opposite end to the said one end. In use, the anode is passed down through a tube connected to the structure to be protected and the nose piece assists in travel of the rods through the tube.

One only of the rods may be provided with an electrical connection at the one end, the remaining rods being electrically connected through the rigid ties. There may be provided an end stop into which the rods are connected, the end stop may have a tapered form to cooperate, in use, with a suitable tube.

Figure 3:
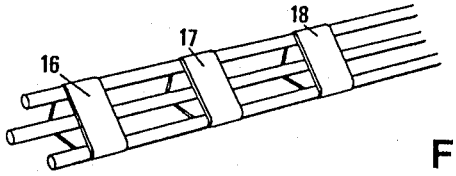
Figure 4:
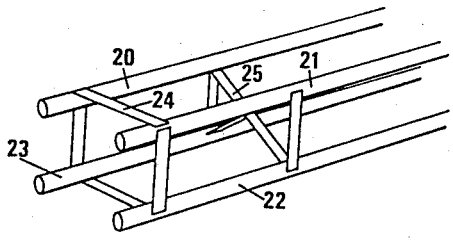
Figure 1:
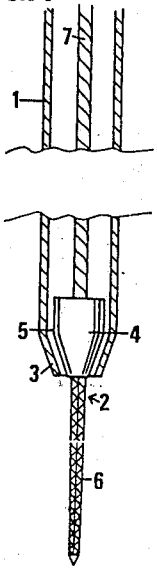
Figure 5:
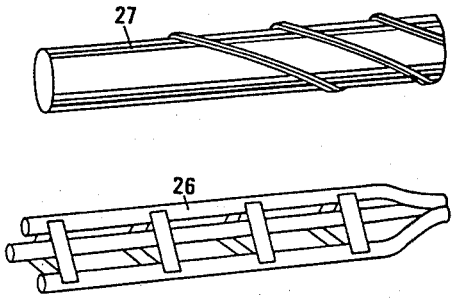
Figure 6:
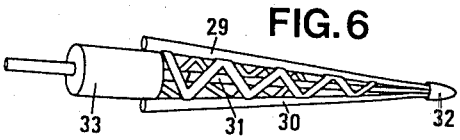

By way of example embodiments of the present invention will now be described with reference to the accompanying drawings of which:

FIG. 1 is a cross-section through an impressed current cathodic protection anode of the invention, FIG. 2 is an enlarged view of the metallic portions of the anode illustrated in FIG. 1, FIG. 3 is a perspective view of an alternative form of tying arrangement, FIG. 4 is a perspective view of an alternative arrangement of anode structure, FIG. 5 is a comparison of a thick anode with an anode in accordance with the invention, and FIG. 6 is a perspective view of a further alternative arrangement of an anode structure.

Referring to FIG. 1 this shows a tube 1 through which an anode assembly indicated generally by 2 is lowered. The tube has a tapered end 3 into which a plug 4 jams by virtue of its mating tapered face 5. The plug 4 carries the lattice-work anode structure 6. A suitable electrical conductor and supported chain or wire 7 extends from the anode assembly to the top of the tube 1. The anode assembly is lowered by the wire 7 and electrical current is fed to the anode through conductors in the wire. If required the anode can be pulled up through the tube by means of a suitable winch (not shown) to which the upper end of the wire 7 is connected.

Referring to FIG. 2 this shows in more detail the metallic components of the anode. Three platinum coated niobium rods 8, 9 and 10 are joined together by means of suitable rigid ties 11, 12 and 13 to form a stable and rigid lattice-work structure. The structure is triangular in cross-section and because the ties 11, 12 and 13 are welded firmly to the rods the structure is very solid. At one end the rods are connected to suitable electrical connections and one arrangement is illustrated in which one rod 8 is bent so that a portion 14 lies along the centre axis of the lattice-work structure. Electrical connections are made to the portion 14 and the whole assembly is then potted in a suitable plastics material to form a plug such as plug 4. At the remote end a nose piece 15 accommodates each of the ends of the rods 8, 9 and 10 to assist in the travel of the anode down through the tube 1. If the tube has any bends in it the nose piece may act to prevent fouling.

The rods would be made of any suitable material such as niobium or titanium coated with any suitable anodically active material such as platinum. Any suitable materials may be used to manufacture the anode assembly. It will be appreciated that in use the anode assembly is only fixed at one end and forms a cantilever. However because of the openness of the lattice-work assembly the anode presents a relatively small cross-sectional area to waves and thus is not so affected by adverse sea conditions as would be a solid rod of the same diameter.

Referring to FIG. 3 it can be seen that alternative forms of rigid ties such as bands 16 and 17 or strips 18 may be used to interconnect the rods. Although the preferred number of rods is believed to be three, four or more rods may be used such as rods 20, 21, 22 and 23—FIG. 4. Again the rods are interconnected by means of suitable ties such as ties 24 and 25.

Comparing the anode of the invention such as anode 26 with a prior art anode such as anode 27 (FIG. 5) it will be appreciated that much less material is needed and that the anode provides a much lower cross-sectional area to the sea and is thus much less likely to be damaged by waves. The ties may be formed of a film-forming metal such as titanium, niobium or other suitable metal compatible with the anode rods themselves.

As shown in FIG. 6, the anode legs 29, 30, 31 can meet at a common point 32. This arrangement has enhanced structural strength, but slightly poorer electrical characteristics. The ends of the legs can be welded to a connection block 33.

Because of the cost of niobium, niobium anodes in accordance with the invention are preferably manufactured from rods having a maximum diameter of 20 mm. If the mechanical strength required for a particular anode is calculated as requiring an anode of 40 mm diameter this would be uneconomical with a solid niobium bar. It has been found, however, that three rods of 12 mm diameter located within a circle which will completely enclose them, the circle having a diameter of 88 mm, is virtually as strong as a 40 mm bar whereas it only contains as much niobium as that of a 20 mm diameter bar. The cost of the anode in terms of the niobium is, therefore, only one quarter by using the three rod lattice structure. Electrically, however, the three 12 mm diameter rods are virtually equivalent to a single rod of approximately 40 mm diameter. The exact figures have been calculated and these show that three 12 mm diameter rods within an enscribed circle of 88 mm are equal in strength to a single rod of 38 mm diameter. Electrically, however, it has been found that the three rod structures do not behave as though they were a single rod which has a diameter of 88 mm, unexpectedly it has been found that the three rods behave as though they were a single bar of 42 mm diameter.

It can be seen, therefore, that the invention enables a significant saving in materials cost whilst providing an anode having virtually the same electrical characteristics as a larger diameter bar. The significance of this is that a 40 mm diameter niobium bar would be hopelessly uneconomic because of the large niobium costs involved.

Clearly the exact figures will vary from example to example but in general the advantages of the invention over a solid rod will always be obtained in terms of increased strength without a corresponding disastrous increase in voltage. It might have been expected, for example, that the three rods within an 88 mm diameter circle would behave as a single rod of 88 mm diameter which electrically would be totally unsatisfactory. It has unexpectedly been found that this is not the case and that the electrical conductance of the assembly remains manageable.

It will be appreciated that one or more of the rods 8, 9 and 10 may be formed of uncoated metal with only some of the rods having the anodically active material on them. By such an arrangement the current density at the anode can be kept relatively high and the anode can be kept long and thin whilst still being suitably rigid and sufficiently strong to withstand the action of waves etc. Also there are three variables, rod diameter, pitch diameter and length, rather than only two with the prior art solid anodes, and by varying the three variables it is easier to optimise conductance, strength, current density—that is the effective utilisation of the precious metal.

I claim:

1. An impressed current anode assembly for use in cathodic protection of underwater structures, said assembly comprising an elongate structure of at least three metallic rods secured in spaced, substantially parallel relationship by a plurality of rigid ties positioned at intervals along the length of the rods, the rods being so disposed that there are at least three planes each including the longitudinal axes of at least two rods, said rods being formed of a film forming metal selected from the group consisting of titanium, zirconium, niobium, hafnium, tantalum and film forming alloys and at least one of the rods having an anodically active material on its surface, said anodically active material being selected from the group consisting of platinum group metals and alloys and anodically active compounds thereof, the assembly being in use anodically connected at one end to a source of direct electric current, and the assembly being arranged to be supported in use at the said one end only.

2. An anode assembly as claimed in claim 1 in which all of the rods are formed of a film-forming metal with an anodically active material on their surfaces.

3. An anode assembly as claimed in claim 2 in which the rods have a core of a metal having a higher electrical conductivity than the film-forming metal.

4. An anode assembly as claimed in claim 3 in which the rods have further a core of reinforcing metal.

5. An anode as claimed in claim 1 wherein the ties are metallic.

6. An anode assembly as claimed in claim 5 including spacing and supporting ties and three rods welded to the spacing and supporting ties.

7. An anode assembly as claimed in claim 6 in which the three rods are equally spaced apart so that the centers of the rods lie on an equilateral triangle.

8. An anode assembly as claimed in claim 1 in which the rods are bent towards a single common position, being provided with a nose piece at that position, and the nose piece being at the opposite end to the said one end.

9. An impressed current corrosion protection system incorporating an anode assembly as claimed in claim 1.

* * * * *